United States Patent [19]

Mendenhall et al.

[11] Patent Number: 4,808,421

[45] Date of Patent: Feb. 28, 1989

[54] FORMED POLYMER FILM PACKAGE FOR MICROWAVE COOKING

[75] Inventors: Abraham H. Mendenhall, Morris County, N.J.; Joseph E. Irace, St. Louis County, Mo.

[73] Assignee: Packaging Concepts, Inc., St. Louis, Mo.

[21] Appl. No.: 17,841

[22] Filed: Feb. 24, 1987

[51] Int. Cl.[4] ..... B65D 81/34; B65D 75/08; B65D 75/12

[52] U.S. Cl. ..... 426/107; 426/111; 426/113; 156/217; 156/313; 229/48 T; 383/104; 383/108; 383/121; 383/125; 493/210; 493/220

[58] Field of Search ..... 229/48 T, 485 B, 485 A; 383/104, 107, 108, 119, 121, 125; 156/313, 306.6, 217, 218; 426/127, 106, 107, 113, 234, 243, 111, 410; 493/210, 220

[56] References Cited

U.S. PATENT DOCUMENTS

| | | | |
|---|---|---|---|
| 2,060,906 | 11/1936 | Snyder | 156/313 |
| 2,771,010 | 11/1956 | Piazze | 383/125 |
| 3,063,845 | 11/1962 | Graves | 383/107 |
| 3,411,542 | 11/1968 | Walsh et al. | 156/218 |
| 3,979,048 | 9/1976 | Stark et al. | 229/48 T |
| 4,133,896 | 1/1979 | Standing et al. | 426/107 |
| 4,399,839 | 8/1983 | Hutschenreuter et al. | 426/105 |
| 4,461,031 | 7/1984 | Blamer | 426/113 |
| 4,571,337 | 2/1986 | Cage et al. | 426/107 |
| 4,584,202 | 4/1986 | Roccaforte | 426/107 |
| 4,691,374 | 9/1987 | Watkins et al. | 426/107 |

FOREIGN PATENT DOCUMENTS

| | | | |
|---|---|---|---|
| 205401 | 5/1956 | Australia | 229/48 T |
| 598883 | 5/1960 | Canada | 229/48 T |
| 1443267 | 7/1976 | United Kingdom | 383/125 |

*Primary Examiner*—Steven Weinstein
*Attorney, Agent, or Firm*—Paul M. Denk

[57] ABSTRACT

A microwavable package, comprising a folded package for use in holding a variety of cookable items, such as popcorn, other food products, or other substances, all to be heated within a microwave oven, the package being formed of a polymer material, comprising one or more liners of such laminated material, with the package being formed into the tubular configuration, and having a paper or paper-like web of material located and adhesively secured within its manufacturer's joint; the formed tubular like material is then folded at its bottom segments, adhered temporarily through the usage of a hot melt of other adhesive, and having a paper or paper like seal applied thereover, to form a fully integrated and foldable package which is capable of functioning and maintaining its structural integrity even when exposed to the energy of a microwave oven. The process for forming this package, through the application of a strip of paper web laminated onto polymer film during the formation of the tubular shape for the intended package, and then cutting the packages along their full intended height, for eventual folding of their bottom flaps into closure, forms the packages of this design.

6 Claims, 2 Drawing Sheets

FORMED POLYMER FILM PACKAGE FOR MICROWAVE COOKING

CROSS REFERENCE TO RELATED APPLICATION

This application relates to the subject matter of the invention described in the U.S. patent application upon Microwavable Package Incorporating Controlled Venting, filed on Oct. 1, 1986, under Ser. No. 913,964.

BACKGROUND OF THE INVENTION

This invention relates to a package for use in the microwaving of cookable items, such as popcorn, other food products, or other substances, and more specifically pertains to a polymer formed package which is held into closure, in the tubular form, through the application of paper means at the location of its formed manufacturer'joint, so as to assure that the packaged remains in its folded integrity even after prolonged exposure to microwave energy during heating of its contained food or other product.

A wide variety of packages have been developed for use in conjuction with a microwave cooker, but most of these packages have been formed of either paper, or related fibrous products, or a combination of paper and glassine or other polymer liners which are laminated together so that the paper maintains an exterior exposure, to the microwave energy, while the interior of the bag has exposure to the internal polymer liner, such as polyethylene or other polyester liner, which has the tendency to effectively prevent moisture or grease transfer, or wicking, through prolonged exposure to the food product or other substance that is contained therein. Such packages have normally performed well for their intended purpose, with the exception that there is always the likelihood that should the paper bag be exposed too excessively to microwave energy, there is a tendency to cause its scorching, or even burning, if precise times are not established for the control of exposure of the microwave energy during a cooking process. In the alternative, the paper packages which are lined with a polymer film, generally have a tendency to break at their marginal seams, or at the manufacturer's joint, due to the ineffectiveness of any adhesive to hold the package or bag into its closed condition, particularly when subjected to the heat of the microwave energy during performance of a heating procedure.

Patents of the foregoing type are generally disclosed in the U.S. Pat. No. 3,851,574, and also in the U.S. Pat. No. 4,571,337. Other United States patents disclosing various types of packages for food, even some of which may be used for microwaving conditions, are shown in the patent to Barnes, et al, No. 2,865,768, and in U.S. Pat Nos. 4,596,713.

Other United States patents disclosing various types of packages used in the process of microwave cooking include the the U.S. Pat. to Colman, No. 2,673,806; the U.S. Pat. to Draper No. 3,689,291; the U.S. Pat. to Hohl, No. 2,189,174; the U.S. Pat. No. 2,633,284; U.S. Pat. No. No. U.S. Pat. No. 3,052,554; U.S. Pat. No. 3,188,215; U.S. Pat. No. 3,204,760; U.S. Pat. No. 3,293,048; U.S. Pat. No. 3,478,952; U.S. Pat. No. 3,511,746; U.S. Pat. No. 3,865,302; U.S. Pat. No. 3,973,045; U.S. Pat. No. 3,997,677; U.S. Pat. No. 4,013,798; U.S. Pat. No. 4,141,487; U.S. Pat. No. 4,145,449; U.S. Pat. No. 4,210,674; U.S. Pat. No. 4,261,504; U.S. Pat. No. 4,292,332; U.S. Pat. No. 4,358,446; U.S. Pat. No. 4,390,554; and U.S. Pat. No. 4,456,164.

It is, therefore, the principal object of this current invention to provide a microwavable package, substantially formed of a polymer material, and which has the attributes of affording both resistance against absorption of the food product or its moisture into the bag structure, either during storage, applied cooking, or subsequent to heating, while at the same time, providing a moisture barrier against either the entrance of moisture into the bag, or its escape therefrom, while likewise maintaining its closed integrity, even along its manufacturer's joint, and even after prolonged exposure to the heat of microwave energy.

Another object of this invention is to provide a foldable package which is fabricated substantially of polymer-like material or liners, either as a singular liner of material, or a lamination of such, and which is completely transparent in appearance, so that its contained food or other product is substantially clear to view during storage, and also while it is being microwaved during cooking.

Another object of this invention is to provide a package for use during microwave cooking and which can have printed indicia applied thereon for the identification of its contents and for advertising of its product, in order to enhance the aesthetics and salability of its contained product.

A further object of this invention is to provide a folded package, substantially, if not completely, formed of polymer formed liner material, and which can be folded into the type of package that is free standing, during display or application, and during usage, or even if subsequently employed as a left-overs container.

Another object of this invention is to provide a folded package which may be heat sealed along its upper margin, during closure, but which when exposed to the internal pressures generated during microwave cooking can be of the self-opening style.

Another object of this invention is to provide a microwavable package which is disposable, or of the throw-away type.

These and other objects will become more apparent to those skilled in the art upon reviewing the summary of this invention, and upon undertaking a study of the description of its preferred embodiment, in view of the drawings.

SUMMARY OF THE INVENTION

This invention contemplates the formation of a folded package, generally of the self-opening style type bag configuration, formed almost totally of polymer-like materials, or a single liner of a polyester, or related polymer material, into the formation of a package for use for microwave cooking and other purposes. The invention generally relates to the need for packaging to act as a cooking container, especially for microwave processing, and eliminate or alleviate the drawbacks which normally plague the usage of existing or state of the art type of packages when expose to microwave energy. With the development of and the need for heat-assist means in a microwave package, and which results in higher heat being generated within the package by the microwave oven, the paper and paper-related containers and packages are limited in usage, and their application must be done under very controlled conditions, due to those dangers involving scorching, burning, or even a flaming of the package during such usage.

Even further, glass and plastic type containers, of the molded type, and which are available in a wide variety of forms and structures, while they might be utilized for microwave purposes, they are relatively high in cost, and therefore, substantially reduces, and even eliminates, their application as packages for food products, or the like, for marketing as a microwavable product, or of the disposable type.

The objective of this current invention is to provide, as previously explained, a microwave cooking container or package, of the throw-away type, or which may have application for a number of uses, during microwaving, and being a package of the type formed of a plastic or polymer film, and which will withstand the heat generated by the microwave oven during its application. Such is performed through the application of the teachings of this invention, without the drawbacks that normally occur through usage of paper or paper combination containers, and yet, the current invention provides a package which is much less expensive than the glass or formed plastic type bowl or tray.

This invention is constructed as a folded package, for use in holding a variety of cookable items, such as popcorn, a variety of food products, or other substances, to be heated, with the package being formed of a polymer or polymer-like material, and with the package being of the type that is constructed of a series of walls and panels, normally disposing a front and back wall, with side gussets integrally formed therein, and further having a bottom panel to provide lower closure. Each of the walls and the bottom panel is formed of a polymer film, and the folded package is generally constructed of the tubular type, made from a roll of the polymer film, which is shaped into the tubular form, cut, and then has its bottom panel folded into its closure configuration. In order to assure the integrity of the package during its usage, and to prevent its manufacturer's joint or side seam from coming apart when exposed to the heat of microwave energy, as the manufacturer's joint is formed, a thin strip of paper or paper-like material is laminated into the joint, between the layers of overlapping polymer film, formed between the approximate side edges of the polymer film when folded into its tubular form. The paper strip is disposed within the manufacturer's joint, is held into position by means of a heat resistant adhesive, which assures that the joint as formed remains heat resistant, to the microwave energy generated during usage of the package while heating of its contained product.

The invention further involves the usage of combination of plys of non-wicking and high heat resistant plastic film such as a polyester, as in the category of polyethylene terephthalate (PET), or other polymer film forming combinations that possess the desirable properties to function as a self-contained package, one that is moisture resistant, but yet functions to effectively pass the microwave energy to the food or other product being subjected to the energy within its cooking environment. By pre-registration of a lamination of two or more plys of the plastic film together, in those instances where the folded package is formed of a lamination of such films, the films may be coextruded into the lamination form, before the film is subjected to equipment that folds it into the tubular form, in preparation for its cutting and folding into the package configuration. Conditions are established for the formation of the lamination into the container or package of this invention, generally upon standard or customary package folding equipment which is of the type that may be used when normally forming paper bags, or the like. The web material, whether it be of a singular layer, or a lamination, is then processed over modified self-opening styled bag equipment to form that size adequate to package or contain the amount of food or other product desired. The resulting container or package is completely sealed on all sides, and at its bottom, with an additional heat seal being provided at its upper edge, so as to assure its being leak proof, during the prolonged period of time that it may be subjected to manufacture, storage, shipment, marketing, or while awaiting usage by the chef.

By virtue of the usage and application of the clear type or transparent polymer film, in forming the package of this invention, the printing upon its surface can be controlled to allow a "see-through picture" of the food that is contained whithin the package, so that the consumers can be assured that the product purchased is exactly what they want, and is processed in the manner desired. Heretofore, only paper/film combinations were available for usage upon this type of packaging equipment, for these end type uses in the microwave. By way of this invention, we now have a complete film package that is readily available by virtue of the pre-registration of the film lamination, and with modifications to the self-opening style equipment to process the non-paper components, with the introduction of the narrowed paper web or sheet of paper-like means within the manufacturer's joint, can form an almost totally transparent or polymer material formed package that significantly enhances not only the aesthetics, but the utility of application of a package when holding a food or other product for microwave processing. The resultant gusseted clear film package is suitable for the microwaving of popcorn, and will avoid the scorch problems that have normally been associated with the prior type of containers when employed for this purpose, particularly those which are formed of the paper/film type of bag, and especially where heat-assist means are employed within such a package. Also, as previously alluded to, as a container which has transparency attributes, the consumer can clearly see the contents of the contained product within the freezer or refrigerator to select that food desired to be cooked at the time within the microwave.

For microwaving of popcorn, the invention of this disclosure functions in the same manner as the existing paper/film type of formed bag. It is of the stand-up self-opening package which can be used to package microwavable popcorn, providing the barrier against permeation of oils, greases, butters, or the like, without the disadvantages that normally plagued the paper or paper-combination microwave type of popcorn containers. These are as previously explained, where paper has a tendency to scorch, and if prolonged exposure beyond that suggested or dictated for usage of the bag is performed, it can cause burning. In addition, paper has a tendency to wick the fluids associated with the popping of popcorn, such as the melted butter, or other oils, or the like.

As the package of this invention is exposed to the refrigerator or freezer, during storage of the contained product, the bag functions very effectively for that particular purpose. Also, the package of this invention provides a low-cost, self-identifying microwave cooking container that may also be used for left-overs, excess foods, or for home frozen foods. Heretofore, only flimsy plastic bags, generally of the thin film polyethylene type, that have no structural integrity to them, and which normally fall over, spill food, and/or which are not heat-resistant, have been available for that particular usage. Paper-associated containers do burn, lose their strength after some point of usage, particularly when exposed to the moisture withing the freezer or refrigerator, and normally offer no substantial protection to its contained or stored food.

To obtain the all-film and self erecting package of this invention, the combination of the pre-registration of the film with the modification in the nature of the paperlike material strip within its manufacturing joint, during manufacturing, results in a unique package heretofore not possible in this foremat for use for the intended and suggested applications. To accomplish the manufacture of the package of this invention, the problem of keeping the film stable throughout the forming process had to be overcome. In addition, a method to provide a back-up enforcement of the film-to-film side seals, or manufacturer's joint, had to be derived as a safety factor for the package when exposed to the microwave cooking cycle. All of this had to be considered, and the problems associated therewith eliminated, in order to produce to a package that would function for the substantial purposes as previously explained, but yet be low in cost of manufacture, be produced at economical machine speeds during mass production runs and for high volume applications.

The problems associated with the prior art, as previously explained, was complicated by the fact that adhesives for gluing a polymer film to a polymer film, especially a film of the PET type, and which would remain stable at temperatures normally subjected to packages within a microwave oven, just do not exist for usage in the manufacturing foremat. Materials normally used, such as the hot melt type of adhesive, break down under heat conditions, particularly when exposed to microwave energy. Both of these objectives, stability in the web for forming the manufacturer's joint type of seal, in a film-to-film setting, to maintain a heat exposed seal, were all accomplished by the introduction of the narrow paper web of this invention into the seam area, generally on the back panel, during formation of the manufacturer's joint when the package was initially machined into the tubular form, during the early stages of formation. Thus, the paper web is controlled in its application into the manufacturer's joint location, by special guide means that positions it in its specific registration, after having adhesive applied to it, so that the web can initially be adhesively adhered to one surface of the polymer film, and then also have its other surface laminated to the opposite side edge of the polymer film, during the tube package formation. To apply the paper web, high heat-resistant adhesive is applied to the polymer film, or the film lamination, or to the paper web itself, at two specific registration locations, on the polymer film, so as to glue the film to paper and then again to the film again at the film-sealing station upon the package forming equipment. Because there are available film-to-paper adhesives, which have effective usage for holding these two type of components together, even when subjected to heat, this type of a system overcomes the lack of an available film-to-film adhesive that can be used in forming a manufacturer's joint containing only polymer film alone.

The result is a film/adhesive/paper web/adhesive/-film lamination in a narrow registration at a location down the entire length of the package formed tube, throughout its height, even before the bottom panel of the package is folded into its closure formation. This in combination with the regular film-to-film heat seal gives the back-up seal system in this critical area, to maintain the integrity of the package during its usage, even when exposed to the high heat of the microwave energy, while at the same time having the paper web provide the stability to hold the film tube in position for forming on the packaging forming equipment.

A further minor refinement in the formation of the package of this invention is provided at the location of its bottom panel, which when it is folded into its folded configuration, to provide bottom closure for the formed package, since only polymer-like material or film is used in the formation of the bag of this invention, when the ears or other flaps are folded and turned in, to form the bottom panel, such flaps or ears have a tendency, because they are made of plastic, to sustain a "memory," and want to remain open, or pull open, rather than remain flat and in their closed condition. Such a condition normally would make it impossible to finish the bottom panel of the formed container, or to apply the bottom patch for assuring its sustaining in closure. Thus, this invention contemplates that application of a dot of hot melt, at strategic locations in the forming bottom panel, beneath the position or area where the ears or flaps are being formed, in order to hold these components within the bottom formed panel, and until such time as a paper or other patch or seal is applied over the bottom and which assures the retention of the bottom wall or panel into its closed integrity, for the duration of any application or usage.

BRIEF DESCRIPTION OF THE DRAWINGS

In referring to the drawings, FIG. 1 provides an isometric view of the folded package of this invention, in its opened condition, readily showing the location of the paper-like web within its formed manufacturer's joint.

DESCRIPTION OF THE PREFERRED EMBODIMENT

Figure 1:
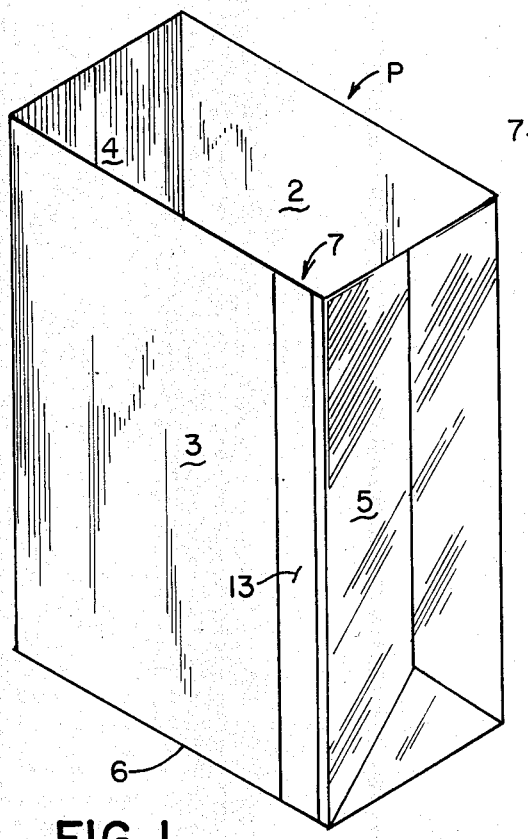
Figure 5:
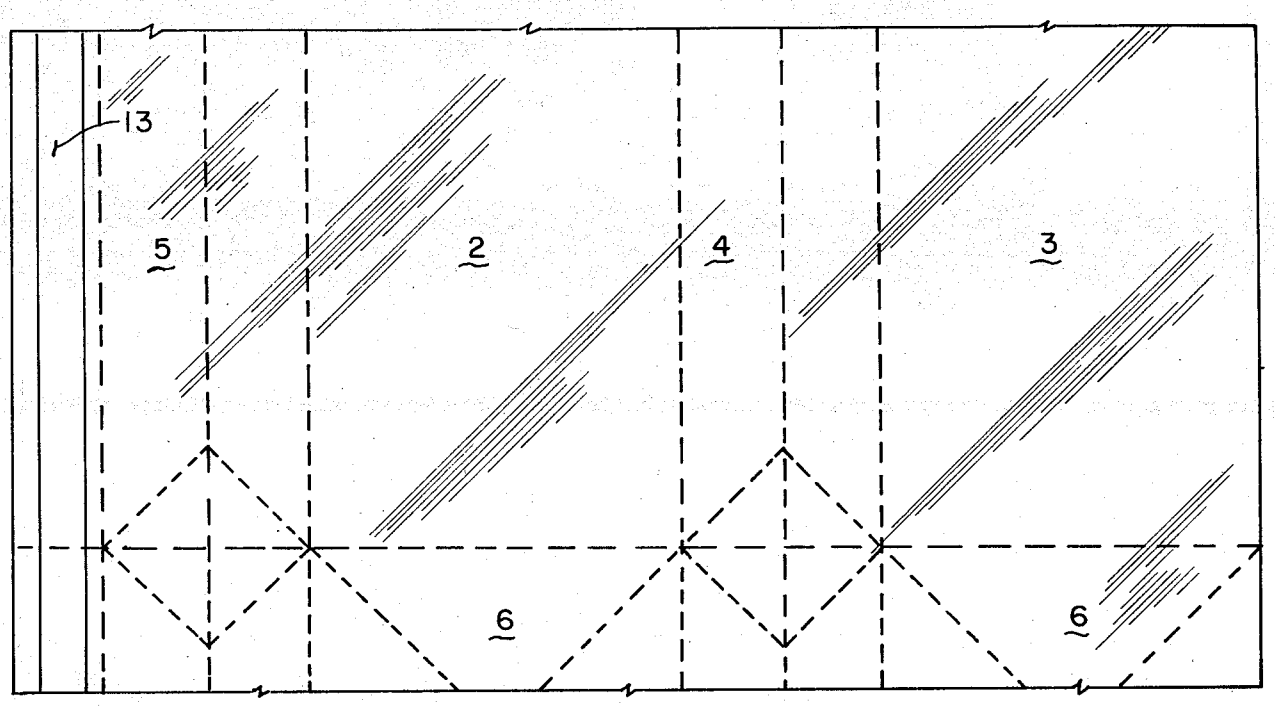
FIG. 5 is a view of the package of this invention in its blank form, within a linear strip of polymer material, before it is folded into its tubular form, or cut to the length of its intended package.

In referring to the drawings, and in particular FIG. 1, the microwave package of this invention, incorporating its novel manufacturer's joint is readily disclosed. The package P incorporates the usual structure of a bag, having a front wall 2, a back wall 3, side walls 4 and 5, and which latter walls may be fabricated of the gusseted design, and with the package also having a bottom wall or panel 6. These particular components for the package, in the blank form, are also depicted in FIG. 5. In addition, the manufacturer's joint 7 is provided for joining the proximate gusseted side wall or panel 5 with the back wall 3, as can be noted. But, obviously, the manufacturer's joint or seam 7, of this design, could be located anywhere around the perimeter of the bag, although for purposes of aesthetics, it is desirable to locate the same upon the intended back panel, or in a side panel, and adjacent one side edge of the formed package. In addition, as can be noted from FIG. 5, there are variety of various bottom panels or flaps, all denoted at 6, and which all fold together in the usual fashion to form the said bottom wall or panel 6 for the fabricated package.

Figure 2:
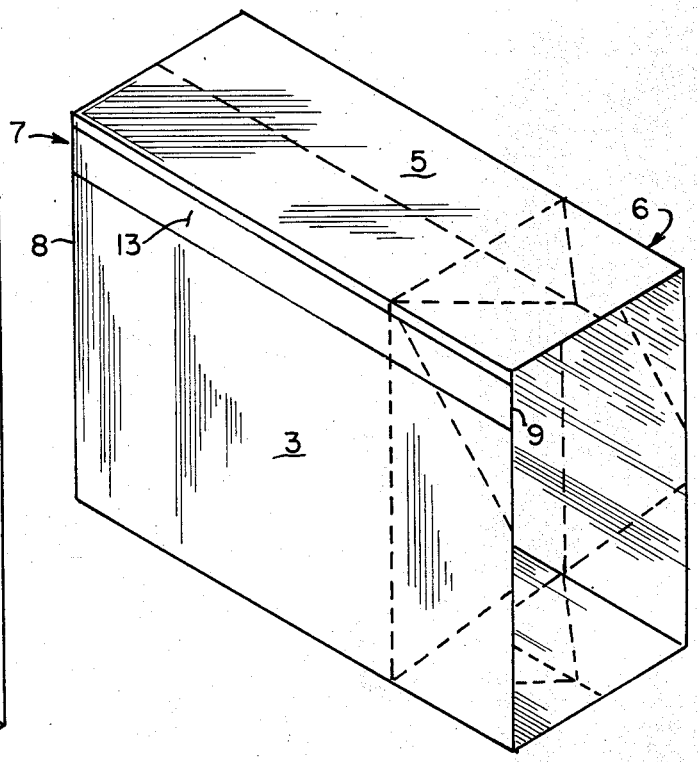
FIG. 2 is a view of the package of FIG. 1, resting on its side, disclosed in the tubular form before its bottom panel is folded into closure.

The main feature of this invention is the fabrication of the specially designed manufacturer's joint 7 into the microwavable package, achieved during fabrication and assembly of the package during its manufacture. More specifically, as can be seen in FIG. 2, which is a view of the package, during its manufacture, and while still in the tubular form, before the bottom panel 6 is folded into closure, the manufacturer's joint 7 is located proximate one side edge of the intended back panel 3, or at a side panel, and runs the full height of the intended package, from its upper edge 8 and down to the lower edge of the cut tubular shaped polymer, as at 9. Thus, as can be readily seen, the manufacturer's joint is fabricated directly into the package, during the initial stages of its assembly, to assure that a tight seal is provided thereat, throughout the height of the package, and to further assure that the lower segments of the formed package will become integrally secure, even through the folding of the manufacturer's joint within the bottom panel 6, when it is collapsed by machinery into the package form, such as shown in FIG. 1.

Figure 3:
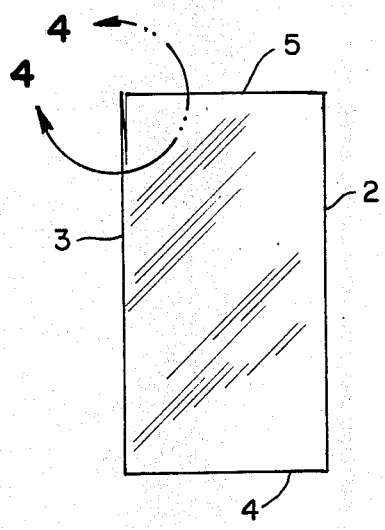
FIG. 3 is a bottom view of the package shown in FIG. 2, highlighting the location of its manufacturer's joint.
Figure 4:
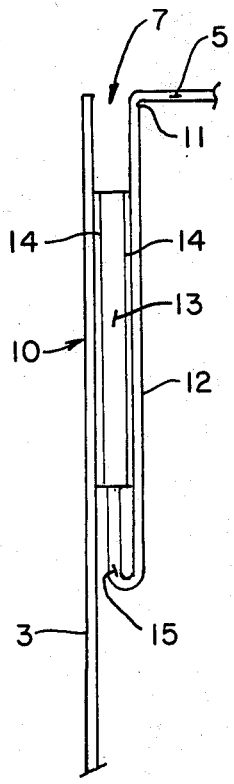
FIG. 4 is an enlarged view of the manufacturer's joint taken along the line 4—4 of FIG. 3.

The details of the manufacturer's joint or seal 7 of this invention are more aptly disclosed in FIGS. 3 and 4. As noted, it can be seen that a segment of the back panel 3 extends into overlying relationship, as at the vicinity of 10, into the formation of the structured seam 7. In addition, the lateral extension from the side wall of gusset 5 folds over, as at 11, to provide integrally a further segment 12 of the polymer liner forming the bag, and which is also structured into the manufacturer's joint. Then, located intermediate the segments 10 and 12, of the polymer bag, is a length of paper or paper like web 13 and which is sealed into position between these components of the bag, in order to assure their fastening permanently into a manufacturer's joint, and one which will remain sealed, even after repeated usage, rough handling, and more especially during exposure of the package to the microwave energy, during cooking of any substance or food that may be contained therein. The length of paper web or strip 13 is firmly held to the separate segments 10 and 12 of the polymer liner or formed package by means of a heat resistant adhesive, layers of the adhesive being shown at 14, which is preferably extended over the width of the paper web, to assure that a rigid seal will be located thereat. As can also be seen, one end of the polymer liner segment 12 may be turned inwardly, as at 15, to act as a spacer to compliment and fill the location between the said segments at this vicinity. But, it is not essential to the functioning of this invention that such an extension 15 necessarily be provided.

It is previously been stated that the type of adhesive to be utilized in the fabrication particularly of the manufacturer's joint of this invention be one that is heat resistant, and perhaps thermal setting, which means that the adhesive, when initially applied to the paper web or specific locations of the liner segments 10 and 12, and when laminated thereon, to form the tubular shaped package, will sustain the adherence of the seam or manufacturer's joint into its closed configuration permanently, and not weaken, fracture, or soften, particularly when exposed to the heat generated by the microwave when producing energy during a cooking cycle. Such adhesives, as the polyvinyl acetate type adhesive, which may be obtained from Laesser Kleb-Staffe Company, of Erlinsbach, Switzerland, and under the brand name and catalog number Lesso 1598-1, is highly satisfactory for producing these intended results. Obviously, other related types of adhesives, or resin based heat resistant adhesives, which can provide a permanent adherence between paper and a polymer, such as the applied PET of this invention, may be used and be satisfactory for achieving the desired results. To simply locate or attempt to adhere the polymer segment 10 to the polymer segment 12, without any intermediate paper web, produces a manufacturer's joint which may hold up under normal usage, but when exposed to the significant heat of the generated microwave energy during cooking, has a tendency to soften, if not separate, under such conditions.

Figure 6:
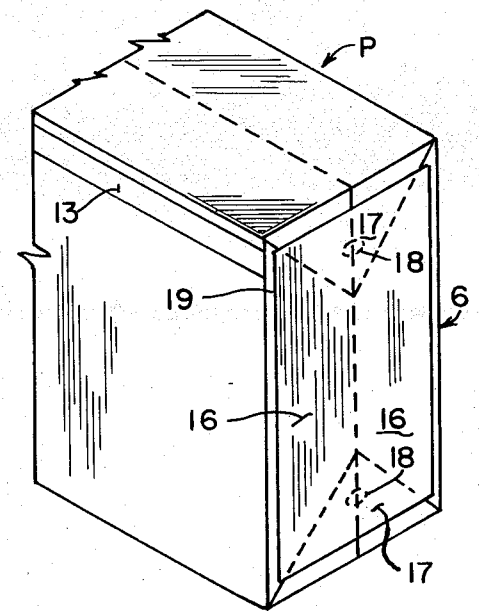
FIG. 6 is a partial view of the package of FIG. 2, after its bottom panel has been folded into closure.

In the assembly of the microwavable package of this invention, once the package is initially formed into the tubular configuration, as shown in FIG. 2, its bottom flaps or panels are folded, along the various fold lines as noted within this particular figure, in order to provide a fully enclosed bag, at least at this vicinity, at its bottom position. This can be seen in FIG. 6. But, as can be readily understood, from the just previous discussion relating to the application of adhesives for holding polymer bags together, to simply fold over the various bottom flaps, which form the bottom panel or wall 6, an attempt to glue them into location, may work for adhering the bottom panel into closure, for usage under normal circumstances and conditions, but when such a package is then utilized in the microwave oven, as can be readily understood, the adhesive becomes softened, and allows the bottom panel to unfold, and to open. This is caused because the polymer material forming the package, when folded over into the multiple folded conditions as shown in FIG. 2, for the bottom panel, such polymer when formed into folded flaps, ears, or the like, have that memory which attempts and urges the such flaps to resiliently move back into their unfolded condition. Thus, as can be readily seen, the tendency of the polymer formed bag, as shown in FIG. 2, is for its bottom flaps, ears, and panels, to be normally urged back into the tubular form, as shown in said disclosure. Hence, during the package's assembly, when the bottom flaps, such as at 16, and the ear portions 17 are folded over into closure, some means must be provided for initially holding these components into their folded configuration. Hence, during fabrication of the package, spots of hot melt, as at 18, are applied onto the folded flaps 16, and then the ears 17 are folded over into closure, and held into their closed position by means of such an adhesive. Following this, a panel of paper, or paper-like material, as at 19, is then glued onto the entire, or nearly the entire, bottom panel 6 of the folded package, through the usage of the type of adhesive as previously explained. Since this bottom panel or seal 19 is fabricated of a paper like material, the adhesive when applying it to the underlying polymer film formed package will provide a permanent adherence between these components, especially when the package is subjected to the energy of a microwave oven.

Figure 7:
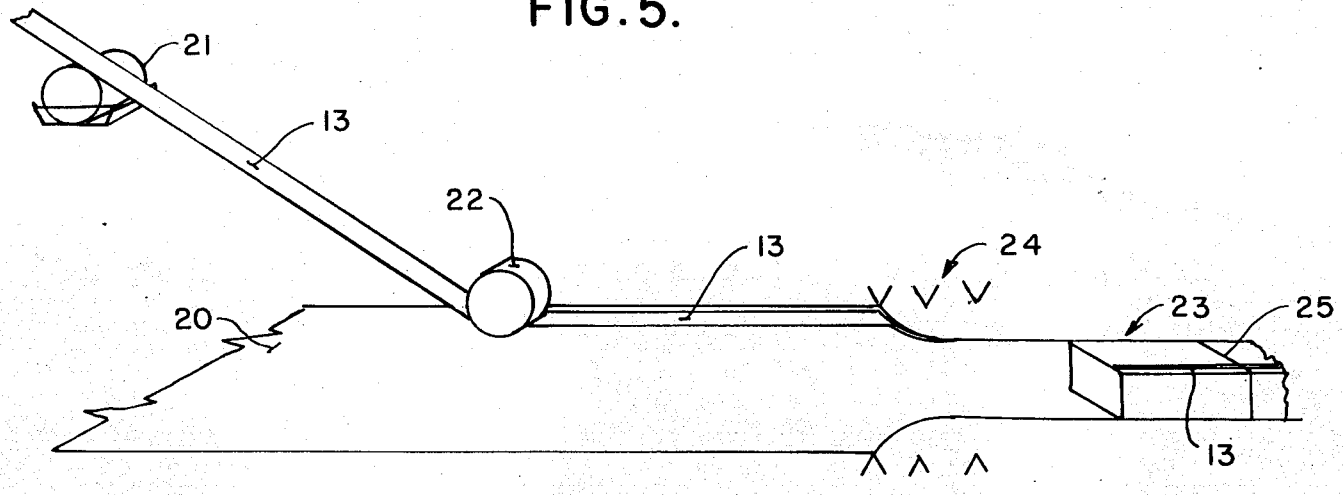
FIG. 7 is a schematic view of the preparation of the polymer film through the application of the paper web of material as it is being folded into the tubular package form, and just prior to its cutting.

A schematic example of just how the package of this invention is derived from the beginning materials can be readily seen in FIG. 7. A continuous roll of polymer material, as at 20, is unrolled into the manufacturing process. And, this may comprise a singular sheet of polymer material, such as the polymer as previously summarized, or it may be a lamination of such polymers, brought together in the manner as shown in FIG. 1 of the prior invention disclosed in the application having Ser. No. 913,964. Films having a thickness of from 5 to 20 mils, more or less, have been satisfactory for the application. Nevertheless, the individual or plurality of laminated polymer sheets are moved along the manufacturing line, and a strip of the paper web 13 is brought into contact with an adhesive applying roll, as at 21, to provide for the adherence of the strip by means of the roller 22 onto the polymer sheet. At this stage, through the application of packaging machinery, the combined sheet 20 with its adhering paper strip 13 is moved into position where the combination is rolled into the tubular form, such as shown at 23. The application of pressure, as at 24, through the usage of customary machinery, can be seen, and at this stage further adhesive may be applied to the web 13, or it may be applied through the application of an additional roller, such as another roller like the roller 21, or another adhesive applying roller, in order to provide a tacky surface upon the upper side of the web 13, such that when the sheet 20 is folded over into the tubular form, the web 13 will then adhere permanently to the approximately opposite side edge of the tubular formed package, as can be seen at the right hand side in FIG. 7. Following this, periodic cuts, as at 25, are made in the tubular package, these cuts being made at a length apart to provide the full height and bottom panel for the intended package, of the type as shown in FIG. 2. Then, exposure of the cut package to further bag folding equipment and machinery folds over the intended bottom wall 6 of the subject package, along those fold lines as generally shown in FIG. 2, with application of spots of the hot melt 18, at the locations where noted, and as previously described, to secure the bottom flaps and ears into their closed configuration, at which time a bottom seal or paper panel 19 is applied into position, to form a totally integrated and fully enclosed and sealed bottom wall for the intended package. At this juncture, the package in collapsed form may be shipped to a food processing company, or any other manufacturer requiring a bag of this configuration, for filling with a designated product, of the type that preferably will be eventually subjected to microwave energy, and then the top edge of the package will be heat sealed or otherwise adhered into closure, to provide a fully integrated package, filled with its intended product, but yet completely sealed against any ambient conditions that exist externally of the formed bag. The package, when in this condition, is ready for storage, shipment, marketing to the trade, and usage by the consumer. Most important, the package may be almost fully transparent. And as previously explained, the bag may even have reusage attributes, such as by the homemaker, when desiring to apply such a bag for leftover food product, for freezing or refrigeration, or for general storage, and subsequent reheating within a microwave oven.

Variations or modifications to the subject matter of this invention may occur to those skilled in the art upon reviewing the disclosure herein. Such variations or modifications, if within the spirit of this invention, are intended to be encompassed within the scope of any claims to patent protection issuing upon this invention. The description of the preferred embodiment set forth herein, and as shown in the drawings, are provided for illustrative purposes only.

Having thus described the invention what is claimed and desired to be secured by Letters Patent is:

1. For use in a microwave oven, a folded package holding cookable food products to be heated for consumption, said package being substantially formed of a polymer film, said polymer film having a pair of side edges and being folded to form a tube having overlapping side edges, and said package being of the tubular formed type having a series of walls and having a formed bottom panel, said walls comprising a front panel, a back panel, and inwardly folded gusseted side panels, said panels being disposed such that the package can be substantially flattened with the gussets closed and the front and back panels substantially arranged in contiguity with each other along a center section and between said gussets, said package having an upper edge, said package also having said bottom panel providing lower closure for the package, and with said food products to be cooked resting within the package and substantially upon the said bottom panel, said panels formed from said polymer film, at least one of said wall panels in combination with the bottom panel having a manufacturer's joint formed therein, the manufacturer's joint extending the height of the tubular formed package before the formation of its formed bottom panel, said manufacturer's joint disposed approximate said overlapping side edges of the polymer film forming the folded package, a narrow paper strip disposed within the manufacturer's joint and intermediate the said overlapping side edges of the polymer film forming the package, said paper strip being adhesively secured by means of a heat resistant adhesive within the said joint to said overlapping side edges of the polymer film, said heat resistant adhesive being a polyvinyl acetate, and said formed joint being heat resistant to the microwave energy generated during usage of the said package while microwave heating of said food products, said package being substantially fully transparent.

2. The invention of claim 1 and wherein said polymer film forming the package being a polyester film.

3. The invention of claim 2 and wherein said polyester film being polyethylene terephthalate.

4. The invention of claim 1 and wherein said polymer film is formed of a laminate.

5. The invention of claim 1 and wherein said bottom panel incorporating a series of folds to form said lower closure, and a bottom seal provided for adhesively adhering upon said folded bottom panel to insure closure for the package at said lower location.

6. The invention of claim 5 and including positioned hot melt adhesively adhering said bottom panel folds into their folded configuration before the application of said bottom seal.

* * * * *